US005505866A

United States Patent [19]

Bacon et al.

[11] Patent Number: 5,505,866

[45] Date of Patent: Apr. 9, 1996

[54] SOLID PARTICULATE FABRIC SOFTENER COMPOSITION CONTAINING BIODEGRADABLE CATIONIC ESTER FABRIC SOFTENER ACTIVE AND ACIDIC PH MODIFIER

[75] Inventors: Dennis R. Bacon, Milford; Toan Trinh, Maineville, both of Ohio

[73] Assignee: The Procter & Gamble Company, Cincinnati, Ohio

[21] Appl. No.: 320,479

[22] Filed: Oct. 7, 1994

[51] Int. Cl.[6] ..... D06M 13/46; D06M 13/00

[52] U.S. Cl. ..... 252/8.6; 252/8.7; 252/8.75; 252/8.8; 252/8.9

[58] Field of Search ..... 252/8.6, 8.8, 8.7, 252/8.75, 8.9

[56] References Cited

U.S. PATENT DOCUMENTS

| | | | |
|---|---|---|---|
| 2,322,821 | 6/1943 | Brown | 260/345 |
| 3,888,998 | 6/1975 | Sampson et al. | 426/67 |
| 4,007,134 | 2/1977 | Liepa et al. | 252/455 |
| 4,128,484 | 12/1978 | Barford et al. | 252/8.8 |
| 4,237,155 | 12/1980 | Kardouche | 427/242 |
| 4,365,061 | 12/1982 | Szejtli et al. | 536/103 |
| 4,661,267 | 4/1987 | Dekker et al. | 252/8.8 |
| 4,711,730 | 12/1987 | Gosselink et al. | 252/8.75 |
| 4,749,596 | 6/1988 | Evans et al. | 427/242 |
| 4,756,850 | 7/1988 | Nayar | 252/547 |
| 4,767,547 | 8/1988 | Straathof et al. | 252/8.8 |
| 4,808,321 | 2/1989 | Walley | 252/8.8 |
| 4,818,569 | 4/1989 | Trinh et al. | 427/242 |
| 4,840,738 | 6/1989 | Hardy et al. | 252/8.6 |
| 4,877,896 | 10/1989 | Maldonado et al. | 560/14 |
| 4,915,854 | 4/1990 | Mao et al. | 252/8.8 |
| 4,954,635 | 9/1990 | Rosario-Jansen et al. | 548/354 |
| 4,956,447 | 9/1990 | Gosselink et al. | 528/272 |
| 4,976,879 | 12/1990 | Maldonado et al. | 252/8.7 |
| 5,019,280 | 5/1991 | Caswell et al. | 252/8.8 |
| 5,066,414 | 11/1991 | Chang | 252/8.8 |
| 5,185,088 | 2/1993 | Hartman et al. | 252/86 |

FOREIGN PATENT DOCUMENTS

| | | |
|---|---|---|
| 243735A2 | 11/1987 | European Pat. Off. . |
| 409502A2 | 1/1991 | European Pat. Off. . |
| 63-294316 | 11/1988 | Japan . |
| 1249129 | 10/1989 | Japan . |
| 4-333667 | 11/1992 | Japan . |

*Primary Examiner*—Anthony Green
*Attorney, Agent, or Firm*—Robert B. Aylor; Jerry J. Yetter; Jacobus C. Rasser

[57] ABSTRACT

Improved solid particulate, granular fabric softening compositions contain biodegradable cationic ester fabric softener actives, especially quaternary ammonium softeners containing two long hydrophobic chains interrupted by ester linkages, and acidic pH modifier, in an effective amount to provide a pH, when the particulate compositions are diluted with water to make liquid softener compositions, of from about 2 to about 5. The solid particulate, granular fabric softening compositions, when added to water, form chemically stable dilute, or concentrated liquid, softener compositions.

32 Claims, No Drawings

SOLID PARTICULATE FABRIC SOFTENER COMPOSITION CONTAINING BIODEGRADABLE CATIONIC ESTER FABRIC SOFTENER ACTIVE AND ACIDIC PH MODIFIER

TECHNICAL FIELD

The present invention relates to improved solid particulate, granular fabric softening compositions containing biodegradable cationic ester fabric softener actives and acidic pH modifier. In particular, it especially relates to solid particulate, granular fabric softening compositions which, when added to water, form chemically stable dilute, or concentrated liquid, softener compositions.

BACKGROUND OF THE INVENTION

The most common and popular rinse-added fabric conditioner products are liquid products. Rinse-added liquid softeners are easy to handle, e.g., easy to dispense and to measure. The liquid form also minimizes the potential for concentrated deposition of the softener on an area of a fabric to cause visible staining. Some automatic clothes washers built with an automatic fabric softener dispenser require the fabric softener in liquid form for proper dispensing.

On the other hand, liquid fabric softener compositions contain a high level of water. The traditional liquid fabric softener products normally contain about 90% to about 95% of water. These products require a great amount of packaging material, the transport of large weight (making shipping expensive), and large shelf space in the retail stores. Recent trends to produce concentrated fabric softeners, with the intention of reducing waste, have improved the environmental impact and decreased the water content in the liquid compositions to about 72% to 80%, which is still a significant amount of water. Parallel with the effort to increase the level of fabric softener active in the liquid composition, another significant improvement in the fabric softener art is the development of rapidly biodegradable fabric softener actives to improve the environmental friendliness of fabric softener products. The new actives consist mainly of cationic quaternary ammonium compounds containing long chain alkyl groups, with at least one ester functional group inserted in some or all of the long chain alkyl groups. Such cationic quaternary ammonium compounds are disclosed, e.g., in E. P. Appln 409,502, Tandela et al., published Jan. 23, 1991; Jap. Pat. Appln 63-194,316, filed Nov. 21, 1988; Jap. Pat. Appln. 4-333,667, published Nov. 20, 1992; Jap. Laid Open Publication 1,249,129, filed Oct. 4, 1989; U.S. Pat. No. 4,767,547, issued Aug. 30, 1988; U.S. Pat. No. 4,808,321, issued Feb. 28, 1989; E. P. Appln 243,735, published Nov. 4, 1987; and U.S. Pat. No. 5,066,414, issued Nov. 19, 1991, all said patents and patent applications being incorporated herein by reference.

Solid rinse-added fabric softener compositions containing biodegradable fabric softener actives are disclosed in U.S. patent application Ser. Nos. 07/881,979, Baker et al., filed May 12, 1992, for Concentrated Fabric Softener Composition Containing Biodegradable Fabric Softener and 08/261,317, Hartman et al., filed Jun. 16, 1994, for Method of Using Solid Particulate Fabric Softener in Automatic Dosing Dispenser, and U.S. Pat. No. 5,185,088, Hartman et al., issued Feb. 9, 1993, said applications and said patent being incorporated herein by reference. In general, it is disclosed that the solid fabric softener can either be added directly into the rinse bath, or pre-diluted with water into a liquid composition prior to its addition into the rinse bath. As discussed before, the benefits of solid compositions include: the compactness of the compositions permit the transport of less weight, making shipping more economical; less packaging is required so that smaller and more readily disposable containers can be used; there is less chance for messy leakage; and less shelf space is required in the retail stores.

When the solid softener composition is added directly into the rinse bath of an automatic clothes washer, normally a top-loading clothes washer, with a short rinse cycle of about 2 to about 4 minutes and with normally cold rinse water, the solid softener composition tends not to be thoroughly dissolved and dispersed, which can lead to concentrated residues being deposited on some part of some fabrics to cause unacceptably visible stains. Furthermore, when the fabric softener can only be added via a dispenser, such as is the case with most front-loading clothes washers, the fabric softener composition is preferably, or necessarily, in the liquid form to minimize residue build-up in the dispenser. Therefore, it is preferred that at home, the consumers pre-dilute by adding both diluted water and the solid compositions into available permanent containers, to form and store liquid products, that are ready for subsequent laundry treatment.

When the liquid compositions are thus reconstituted from solid compositions containing biodegradable cationic ester (preferably diester) quaternary ammonium fabric softener actives having ester groups in the alkyl chains, the softener actives are somewhat labile to hydrolysis, and the softener actives are degraded rather rapidly upon storage. Therefore, it is the purpose of this invention to provide solid particulate, granular fabric softening compositions containing biodegradable cationic diester quaternary ammonium fabric softener actives to which water can be added to form dilute or concentrated liquid softener compositions which are chemically stable upon long-term storage.

SUMMARY OF THE INVENTION

The present invention relates to a rinse-added solid particulate, granular fabric softening composition comprising:

I. from about 50% to about 95%, by weight of the composition, of biodegradable, cationic diester quaternary ammonium fabric softening compound;

II. from about 0.01% to about 20%, by weight of the composition, of acid pH modifier in an amount sufficient to create and maintain a pH of from about 2 to about 5 when the composition is added to water; and III. from about 0% to about 30%, by weight of the composition, of dispersibility modifier.

DETAILED DESCRIPTION OF THE INVENTION

(I) Biodegradable Cationic Fabric Softener Active

The preferred fabric softener active is biodegradable cationic ester quaternary ammonium softener active containing ester linkages in the long hydrophobic groups (EQA) having the formula:

$$E^{p+}[Y—R^2]_m\ pX^-$$

wherein: p is 1 or 2; m is 2 or 3; each E is a nitrogenous quaternary ammonium group of charge p+; each Y is —O—(O)C—, or —C(O)—O—; $R^2$ is the same or different $C_{11}$–$C_{22}$ hydrocarbyl or substituted hydrocarbyl substituent, preferably alkyl and/or alkenyl; and $X^-$ is any softener-compatible anion such as chloride, bromide, methylsulfate, ethyl sulfate, formate, nitrate and the like.

Preferably E is selected from the group consisting of:

(1) $(R)_{4-m}N^+[(CH_2)_n—]_m$ with m being 2 or 3;

(2) $(R)_3N^+(CH_2)_nCH—CH_2$ wherein n is from 1 to 4; and (3) mixtures thereof, wherein each R is a $C_{1-6}$ alkyl or substituted alkyl group (e.g., hydroxy alkyl, hydroxy ethyl, hydroxy propyl), preferably $C_{1-3}$ alkyl group, e.g., methyl (most preferred), ethyl, propyl, and the like, a benzyl group, hydrogen, or mixtures thereof, and, also preferably, $R^2$ is derived from $C_{12-24}$ fatty acyl groups.

A preferred EQA, with E of the formula (1) above, has the formula:

$$(R)_{4-m}N^+[(CH_2)_n—Y—R^2]_m\ X^-$$

wherein: Y=—O—(O)C—, or —C(O)—O—; m=2 or 3; each n=1 to 4; each R substituent is a short chain $C_1$–$C_6$, preferably $C_1$–$C_3$, alkyl group, e.g., methyl (most preferred), ethyl, propyl, and the like, $C_1$–$C_3$ hydroxyalkyl group, benzyl, or mixtures thereof; each $R^2$ is a long chain, preferably at least partially unsaturated, e.g., Iodine Value (IV) of greater than about 5 to less than about 100, $C_{11}$–$C_{21}$ hydrocarbyl, or substituted hydrocarbyl group; and the counterion, $X^-$, can be any softener-compatible anion, for example, chloride, bromide, methylsulfate, formate, sulfate, nitrate and the like.

Non-limiting examples of biodegradable softener actives with E (1) are N,N-di(tallowoyloxyethyl)-N,N-dimethylammonium chloride and N,N-di(tallowoxyethyl)-N-(2-hydroxyethyl)-N-methylammonium methyl sulfate.

A non-limiting example of a biodegradable softener active with E (2) is 1,2-ditallowoyloxy-3-trimethylammoniopropane chloride.

EQA compounds prepared with fully saturated alkyl groups ($R^2$) are rapidly biodegradable and excellent softeners. However, compounds prepared with at least partially unsaturated alkyl groups have many advantages (i.e., concentratability and good storage viscosity) and are highly acceptable for consumer products. EQA with unsaturated alkyl groups also provide improved static control and fabric water absorbency benefits as compared to EQA with saturated alkyl groups.

Variables that must be adjusted to obtain the largest benefits of using unsaturated acyl groups include the Iodine Value (IV) of the fatty acids; the cis/trans isomer weight ratios in the fatty acyl groups; and the odor of fatty acid and/or the EQA. Any reference to IV values hereinafter refers to IV of fatty acyl/alkyl groups and not to the resulting EQA compound.

When the IV of the fatty acyl groups is above about 20, the EQA provides excellent antistatic effect. Antistatic effects are especially important where the fabrics are dried in a tumble dryer, and/or where synthetic materials which generate static are used. Maximum static control occurs with an IV of greater than about 20, preferably greater than about 40.

As the IV is raised, there is a potential for odor problems. Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance.

EQA derived from highly unsaturated fatty acyl groups, i.e., fatty acyl groups having a total unsaturation above about 65% by weight, do not provide any additional improvement in antistatic effectiveness. They may, however, be able to provide other benefits such as improved water absorbency of the fabrics. In general, an IV range of from about 40 to about 65 is preferred for concentratability, maximization of fatty acyl sources, excellent softness, static control, etc.

Highly concentrated aqueous dispersions of diester compounds can gel and/or thicken during low (40° F.) temperature storage. Diester compounds made from only unsaturated fatty acids minimize this problem but additionally are more likely to cause malodor formation. Compositions containing diester compounds made from fatty acids having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these IV ranges. In the IV range above about 25, the ratio of cis to trans isomers is less important unless higher concentrations are needed. For any IV, the concentration that will be stable in an aqueous composition will depend on the criteria for stability (e.g., stable down to about 5° C.; stable down to 0° C.; doesn't gel; gels but recovers on heating; etc.) and the other ingredients present, but the concentration that is stable can be raised by adding concentration aids to achieve the desired stability.

Generally, hydrogenation of fatty acids to reduce polyunsaturation and to lower IV to insure good color and improved odor and odor stability leads to a high degree of trans configuration in the molecule. However, diester compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid 406 from FINA).

It will be understood that $R^2$ can optionally be substituted with various groups such as alkoxyl or hydroxyl groups. Some of the preferred compounds can be considered to be diester variations of ditallow dimethyl ammonium chloride (DTDMAC), which is a widely used fabric softener. Preferably, at least about 80% of the EQA is the diester. Preferably, less than about 20%, more preferably less than about 10%, should be EQA monoester (e.g., containing only one —Y—$R^2$ group).

As used herein, when the diester is specified, it will include the monoester that is normally present. The level of monoester can be controlled during the manufacture of the EQA. Preferably, some of the monoester is present. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1.

Particulate solid, granular compositions of this invention typically contain from about 50% to about 95%, preferably from about 60% to about 90%, of biodegradable diester quaternary ammonium softener active.

(II) Acidic pH Modifier

Since the biodegradable cationic diester quaternary ammonium fabric softener actives are somewhat labile to hydrolysis, acid pH modifiers are essentially incorporated in the solid particulate composition, to which water is to be added, to form stable dilute or concentrated liquid softener compositions. Said reconstituted stable liquid compositions should have a pH (neat) of from about 2 to about 5, preferably from about 2 to about 4.5, more preferably from about 2 to about 4.

The pH can be adjusted by incorporating a solid, water-soluble Bronsted acid and/or a liquid acid and/or acid anhydride that has been convened to a solid. Examples of suitable Bronsted acids include inorganic mineral acids, such as boric acid, sodium bisulfate, potassium bisulfate, sodium phosphate monobasic, potassium phosphate monobasic, and mixtures thereof; organic acids, such as citric acid, gluconic acid, glutamic acid, tartaric acid, fumaric acid, maleic acid, malic acid, tannic acid, glycolic acid, chloroacetic acid, phenoxyacetic acid, 1,2,3,4-butane tetracarboxylic acid, benzene sulfonic acid, ortho-toluene sulfonic acid, para-toluene sulfonic acid, phenol sulfonic acid, naphthalene sulfonic acid, benzene phosphonic acid, oxalic acid, 1,2,4,5-pyromellitic acid, 1,2,4-trimellitic acid, adipic acid, benzoic acid, phenylacetic acid, salicylic acid, succinic acid, and mixtures thereof; and mixtures of mineral inorganic acids and organic acids. Preferred pH modifiers are citric acid, gluconic acid, tartaric acid, malic acid, 1,2,3,4-butane tetracarboxylic acid, and mixtures thereof.

Optionally, materials that can form solid clathrates such as cyclodextrins and/or zeolites, etc., can be used as adjuvants in the solid particulate composition as host carriers of concentrated liquid acids and/or art hydrides, such as acetic acid, HCl, sulfuric acid, phosphoric acid, nitric acid, carbonic acid etc. An example of such solid clathrates is carbon dioxide adsorbed in zeolite A, as disclosed in U.S. Pat. No. 3,888,998, Whyte and Samps, issued Jun. 10, 1975 and U.S. Pat. No. 4,007,134, Liepe and Japikse, issued Feb. 8, 1977, both of said patents being incorporated herein by reference. Examples of inclusion complexes of phosphoric acid, sulfuric acid, and nitric acid, and process for their preparation are disclosed in U.S. Pat. No. 4,365,061, issued Dec. 21, 1982 to Szejtli et al., said patent being incorporated herein by reference.

The acidic pH modifier is typically used at a level of from about 0.01% to about 20%, preferably from about 0.1% to about 10%, more preferably from about 0.2% to about 5%. The amount of pH modifier should be sufficient to allow for interactions between the acidic pH modifier and the minerals in the water used to dilute the solid particulate fabric softener composition.

(III) Optional Dispersibility Modifiers

Dispersibility modifiers can be added for the purpose of facilitating the solubilization and dispersion of the solid compositions of the present invention, to form concentrated dispersion and/or to improve phase stability (e.g., viscosity stability) of the reconstituted liquid compositions.

(1) The Single-Long-Chain Alkyl Cationic Surfactant

The mono-long-chain-alkyl (water-soluble) cationic surfactants is optionally used at a level of from 0% to about 30%, preferably from about 3% to about 15%, more preferably from about 5% to about 15%, the total single-long-chain cationic surfactant present being at least at an effective level.

Such mono-long-chain-alkyl cationic surfactants useful in the present invention are, preferably, quaternary ammonium salts of the general formula:

$$[R^3N(^+)R_3]\ X(^-)$$

wherein the each R group is a $C_1$–$C_3$ alkyl or hydroxyalkyl group, e.g., methyl, ethyl, hydroxyethyl, and the like, hydrogen, and mixtures thereof; the $R^3$ group is $C_{10}$–$C_{22}$ hydrocarbon group, preferably $C_{12}$–$C_{18}$ alkyl group or the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester. Each R and $X(^-)$ has the same meaning as before.

The ranges above represent the amount of the single-long-chain-alkyl cationic surfactant which is added to the composition of the present invention. The ranges do not include the amount of monoester which is already present in component (A), the diester quaternary ammonium compound, the total present being at least at an effective level.

The long chain group $R^3$, of the single-long-chain-alkyl cationic surfactant, typically contains an alkyl group having from about 10 to about 22 carbon atoms, preferably from about 12 to about 16 carbon atoms for solid compositions, and preferably from about 12 to about 18 carbon atoms for liquid compositions. This $R^3$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, the acid pH modifier which is added to keep the ester groups stable will also keep the amine protonated in the compositions and preferably during the rinse so that the amine has a cationic group. The composition is adjusted to a pH of from about 2 to about 5, preferably from about 2 to about 4, to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to disperse and solubilize the solid compositions and/or lower the viscosity of the reconstituted liquid composition, and it is not, therefore, essential that the cationic surfactant itself have substantial softening properties, although this may be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures. Some alkyl imidazolinium salts useful in the present invention have the general formula:

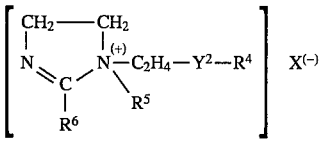

wherein $Y^2$ is —C(O)—O—, —O—(O)—C—, —C(O)—N($R^7$), or —N($R^7$)—C(O)— in which $R^7$ is hydrogen or a $C_1$–$C_4$ alkyl group; $R^5$ is a $C_1$–$C_4$ alkyl group; $R^4$ and $R^6$ are each independently selected from R and $R^3$ as defined hereinbefore for the single-long-chain cationic surfactant, with only one being $R^3$, and $X^{(-)}$ has the same meaning as before.

Some alkyl pyridinium salts useful in the present invention have the general formula:

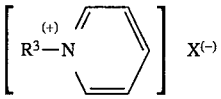

wherein $R^3$ and $X^{(-)}$are as defined above. A typical material of this type is cetyl pyridinium chloride.

Amine oxides can also be used. Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis(2-hydroxyethyl)dodecylamine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(2) Nonionic Surfactant (Alkoxylated Materials)

Suitable nonionic surfactants which can serve as the viscosity/dispersibility modifier include addition products of ethylene oxide and, optionally, propylene oxide, with fatty alcohols, fatty acids, fatty amines, etc. They are referred to as ethoxylated fatty alcohols, ethoxylated fatty acids, and ethoxylated fatty amines.

Any of the alkoxylated materials of the particular type described hereinafter can be used as the nonionic surfactant. In general terms, the nonionic herein, when used alone, in solid compositions, is at a level of from about 5% to about 20%, preferably from about 8% to about 15%. Suitable compounds are substantially water-soluble surfactants of the general formula:

$$R^2—Y^3—(C_2H_4O)_n—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length is from about 8 to about 18 carbon atoms and more preferably from about 10 to about 14 carbon atoms. In the general formula for the ethoxylated nonionic surfactants herein, $Y^3$ is typically —O—, —C(O)O—, —C(O)N(R)—, or —C(O)N(R)R—, in which $R^2$, and R, when present, have the meanings given hereinbefore, and/or R can be hydrogen, and n is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups may possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(3) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "tallow" chain length range are also useful herein. Specific examples of such materials include tallowalcohol-EO(11), tallowalcohol-EO(18), and tallowalcohol -EO(25).

(4) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity/dispersibility modifiers in the context of this invention. Exemplary ethoxylated secondary alcohols useful herein as the viscosity/dispersibility modifiers of the compositions are: 2-$C_{16}$EO(11); 2-$C_{20}$EO(11); and 2-$C_{16}$EO(14).

(5) Alkyl Phenol Alkoxylates

As in the case of the alcohol alkoxylates, the hexa- through octa-decaethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionic containing a phenylene group are considered to contain an equivalent number of carbon atoms calculated as the sum of the carbon atoms in the alkyl group plus about 3.3 carbon atoms for each phenylene group.

(6) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(7) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(8) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

Mixtures of the viscosity/dispersibility modifiers are present for solid compositions at a level of from about 3% to about 30%, preferably from about 5% to about 20%, by weight of the composition.

(IV) Other Optional Ingredients

1. Optional Nonionic Softener

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to EQA is from about 1:6 to about 1:2, preferably from about 1:4 to about 1:2.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about 1 to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society*, Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties [Tweens®] are also useful in the composition of the present invention. Therefore, for purposes of the present invention, the term "sorbitan ester" includes such derivatives.

For the purposes of the present invention, it is preferred that a significant amount of di- and tri-sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or diesters, preferably mono-, are also preferred herein (e.g., polyglycerol monostearate with a trade name of Radiasurf® 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

The performance of, e.g., glycerol and polyglycerol monoesters is improved by the presence of the diester cationic material, described hereinbefore.

Still other desirable optional "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least two long hydrophobic groups (chains).

The ion-pair complexes can be represented by the following formula:

$$[N^+(R^4)_2(R^5)H]\ A^-$$

wherein each $R^4$ can independently be $C_{12}$–$C_{20}$ alkyl or alkenyl, and $R^5$ is H or $CH_3$. $A^-$ represents an anionic compound and includes a variety of anionic surfactants, as well as related shorter alkyl chain compounds which need not exhibit surface activity. $A^-$ is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, olefin sulfonates, preferably benzene sulfonates, and $C_1$–$C_5$ linear alkyl benzene sulfonates, or mixtures thereof.

The terms "alkyl sulfonate" and "linear alkyl benzene sulfonate" as used herein shall include alkyl compounds having a sulfonate moiety both at a fixed location along the carbon chain, and at a random position along the carbon chain. Starting alkylamines are of the formula:

$$(R^4)_2—N—R^5$$

wherein each $R^4$ is $C_{12}$–$C_{20}$ alkyl or alkenyl, and $R^5$ is H or $CH_3$.

The anionic compounds ($A^-$) useful in the ion-pair complex of the present invention are the alkyl sulfonates, aryl sulfonates, alkylaryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

The preferred anions ($A^-$) useful in the ion-pair complex of the present invention include benzene sulfonates and $C_1$–$C_5$ linear alkyl benzene sulfonates (LAS), particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The amine and anionic compound are combined in a molar ratio of amine to anionic compound ranging from about 10:1 to about 1:2, preferably from about 5:1 to about 1:2, more preferably from about 2:1 to about 1:2, and most preferably 1:1. This can be accomplished by any of a variety of means, including but not limited to, preparing a melt of the anionic compound (in acid form) and the amine, and then processing to the desired particle size range.

A description of ion-pair complexes, methods of making, and non-limiting examples of ion-pair complexes and starting amines suitable for use in the present invention are listed in U.S. Pat. No. 4,915,854, Mao et al., issued Apr. 10, 1990, and U.S. Pat. No. 5,019,280, Caswell et al., issued May 28, 1991, both of said patents being incorporated herein by reference.

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of the types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. No. 4,237,155, Kardouche, issued Dec. 2, 1980, said patent being incorporated herein by reference.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri-esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinbefore and hereinafter, or other nonionic softener materials to achieve better results.

The above-discussed nonionic compounds are correctly termed "softening agents," because, when the compounds are correctly applied to a fabric, they do impart a soft, lubricious feel to the fabric. However, they require a cationic material if one wishes to efficiently apply such compounds from a dilute, aqueous rinse solution to fabrics. Good deposition of the above compounds is achieved through their combination with the cationic softeners discussed hereinbefore and hereinafter. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures.

Optional Imidazoline Softening Compound

Optionally, the solid composition of the present invention contains from about 1% to about 30%, preferably from about 5% to about 20%, of a di-substituted imidazoline softening compound of the formula:

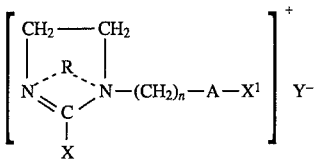

(I)

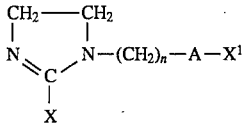

(II)

or mixtures thereof, wherein A is as defined hereinbefore for $Y^2$; $X^1$ and X are, independently, a $C_{11}$–$C_{22}$ hydrocarbyl group, preferably a $C_{13}$–$C_{18}$ alkyl group, most preferably a straight chained tallow alkyl group; R is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and n is, independently, from about 2 to about 4, preferably about 2. The counterion $X^-$ can be any softener compatible anion, for example, chloride, bromide, methylsulfate, ethylsulfate, formate, sulfate, nitrate, and the like.

The above compounds can optionally be added to the composition of the present invention as a DEQA premix fluidizer or added later in the composition's processing for their softening, scavenging, and/or antistatic benefits. When these compounds are added to DEQA premix as a premix fluidizer, the compound's ratio to DEQA is from about 2:3 to about 1:100, preferably from about 1:2 to about 1:50.

Compound (I) can be prepared by quaternizing a substituted imidazoline ester compound. Quaternization may be achieved by any known quaternization method. A preferred quaternization method is disclosed in U.S. Pat. No. 4,954,635, Rosario-Jansen et al., issued Sep. 4, 1990, the disclosure of which is incorporated herein by reference.

The di-substituted imidazoline compounds contained in the compositions of the present invention are believed to be biodegradable and susceptible to hydrolysis due to the ester group on the alkyl substituent. Furthermore, the imidazoline compounds contained in the compositions of the present invention are susceptible to ring opening under certain conditions. As such, care should be taken to handle these compounds under conditions which avoid these consequences. For example, reconstituted stable liquid compositions herein are preferably formulated at a pH in the range of about 1.5 to about 5.0, most preferably at a pH ranging from about 1.8 to 3.5. The pH is adjusted by the pH modifier.

In many cases, it is advantageous to use a 4-component composition comprising: (A) a diester quaternary ammonium cationic softener such as di(tallowoyloxy ethyl) dimethylammonium chloride; (B) a pH modifier; (C) a viscosity/dispersibility modifier, e.g., mono-long-chain alkyl cationic surfactant such as fatty acid choline ester, cetyl or tallow alkyl trimethylammonium bromide or chloride, etc., a nonionic surfactant, or mixtures thereof; and (D) a di-long-chain imidazoline ester compound in place of some of the DEQA. The additional di-long-chain imidazoline ester compound, as well as providing additional softening and, especially, antistatic benefits, also acts as a reservoir of additional positive charge, so that any anionic surfactant which is carried over into the rinse solution from a conventional washing process is effectively neutralized.

2. Stabilizers

Stabilizers can be present in the compositions of the present invention. The term "stabilizer", as used herein, includes antioxidants and reductive agents. These agents are present at a level of from about 0% to about 2%, by weight of the composition, preferably from about 0.01% to about 0.2%, more preferably from about 0.035% to about 0.1%, by weight of the composition, for antioxidants, and more preferably from about 0.01% to about 0.2%, by weight of the composition, for reductive agents. These assure good odor stability under long term storage conditions for the compositions and compounds stored in molten form. The use of antioxidants and reductive agent stabilizers is especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc. (Eastman) under the trade names Tenox® PG and Tenox® S-1; a mixture of BHT (butylated hydroxytoluene), BHA (butylated hydroxyanisole), propyl gallate, and citric acid, available from Eastman, under the trade name Tenox-6®; butylated hydroxytoluene, available from UOP Process Division under the trade name Sustane® BHT; tertiary butylhydroquinone, available from Eastman under the trade name Tenox® TBHQ; natural tocopherols, available from Eastman under the trade name Tenox® GT-1/GT-2; and butylated hydroxyanisole, available form Eastman under the trade name BHA®; long chain esters ($C_8$–$C_{22}$) of gallic acid, e.g., dodecyl gallate; Irganox® 1010; Irganox® 1035; Irganox® B 1171; Irganox® 1425 Irganox® 3114; Irganox® 3125; and mixtures thereof, preferably Irganox® 3125, Irganox® 1425, Irganox® 3114, and mixtures thereof, more preferably Irganox® 3125 alone or mixed with citric acid. The chemical names and CAS numbers for some of the above stabilizers are listed in Table I below.

TABLE I

| Antioxidant | CAS No. | Chemical Name used in Code of Federal Regulations |
|---|---|---|
| Irganox ® 1010 | 6682-19-8 | Tetrakis[methylene(3,5-di-tert-butyl-4-hydroxyhydrocinnamate)] methane |
| Irganox ® 1035 | 41484-35-9 | Thiodiethylene bis(3,5-di-tert-butyl-4-hyrdroxyhydrocinnamate |
| Irganox ® 1098 | 23128-74-7 | N,N'-Hexamethylene bis(3,5-di-tert-butyl-4-hydroxyhydro-cinnamamide |
| Irganox ® B 1171 | 31570-4-4<br>23128-74-7 | 1:1 Blend Irganox ® 1098 and Irgafos ® 168 |
| Irganox ® 1425 | 65140-91-2 | Calcium bis[monoethyl(3,5-di-tert-butyl-4-hydroxybenzyl)hosphonate] |
| Irganox ® 3114 | 27676-62-6 | 1,3,5-Tris(3,5-di-tert-butyl-4-hydroxybenzyl)-s-triazine-2,4,6-(1H,3H,5H)trione |
| Irganox ® 3125 | 34137-09-2 | 3,5-Di-tert-butyl-4-hydroxy-hydrocinnamic acid triester with 1,3,5-tris(2-hydroxyethyl)-S-triazine-2,4,6-(1H,3H,5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

3. Inorganic Viscosity Control Agents

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 ppm, preferably from about 20 to about 4,000 ppm, by weight of the composition.

4. Soil Release Agent

In the present invention, an optional soil release agent can be added. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A more complete disclosure of soil release agents is contained in U.S. Pat. Nos.: 4,661,267, Decker et al., issued Apr. 28, 1987; 4,711,730, Gosselink et al., issued Dec. 8, 1987; 4,749,596, Evans et al., issued Jun. 7, 1988; 4,818,569, Trinh et al., issued Apr. 4, 1989; 4,877,896, Maldonado et al., issued Oct. 31, 1989; 4,956,447, Gosselink et al., issued Sep. 11, 1990; and 4,976,879, Maldonado et al., issued Dec. 11, 1990, all of said patents incorporated herein by reference.

5. Scum Dispersant

In the present invention, an optional scum dispersant, other than the soil release agent, can be added.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij® 700; Varonic® U-250; Genapol® T-500, Genapol® T-800; Plurafac® A-79; and Neodol® 25–50.

6. Bacteriocides

Examples of bacteriocides used in the compositions of this invention include glutaraldehyde, formaldehyde, 2-bromo-2-nitro-propane-1,3-diol sold by Inolex Chemicals, located in Philadelphia, Pa., under trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

7. Other Optional Ingredients

The present invention can include optional components conventionally used in textile treatment compositions, for example, short chain alcohols such as ethanol, or propylene glycol, colorants, perfumes, preservatives, silicones, optical brighteners, opacifiers, surfactants, stabilizers such as guar gum and polyethylene glycol, anti-shrinkage agents, fabric crisping agents, spotting agents, germicides, fungicides, anti-corrosion agents, and the like.

(V) Preparation of Solid Particulate Granular Fabric Softener

The granules can be formed by preparing a melt, solidifying it by cooling, and then grinding and sieving to the desired size. In a four-component mixture, e.g., EQA, nonionic softener, acidic pH modifier, and single-long-chain cationic dispersibility modifier, it is preferred, when forming the granules, to pre-mix the nonionic softener and the more soluble single-long-chain alkyl cationic compound before mixing in a melt of the diester quaternary ammonium cationic compound and the acidic pH modifier. It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

(VI) Method of Use

Water is added to the particulate, solid, granular compositions to form dilute or concentrated liquid softener compositions for later addition to the rinse cycle of the laundry process, with a concentration of said biodegradable cationic softening compound of from about 0.5% to about 50%, preferably from about 1% to about 35%, more preferably from about 4% to about 32%.

The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

Depending upon the particular selection of nonionic and cationic surfactant, it may be desirable in certain cases, when using the solids to prepare the liquid, to employ an efficient means for dispersing and emulsifying the particles (e.g., blender).

It is essential that an effective amount of an acidic pH modifier is used to adjust the pH of the reconstituted liquid compositions to from about 2 to about 5, preferably from about 2 to about 4.5, more preferably from about 2 to about 4.

The diluted liquid compositions forms using the solid particulate compositions of the present invention are preferably used in the rinse cycle of the conventional automatic laundry operations. Generally, rinse water has a temperature of from about 5° C. to about 60° C.

Fabrics or fibers are contacted with an effective amount, generally from about 10 ml to about 300 ml (per 3.5 kg of fiber or fabric being treated), of the reconsituted liquid compositions herein in an aqueous bath. Of course, the amount used is based upon the judgment of the user, depending on concentration of the softening material, fiber or fabric type, degree of softness desired, and the like. Typically, from about 10 ml to about 300 ml of from about 5% to about 40% dispersion of the biodegradable cationic fabric softener active is used in an approximately 20 gallon laundry rinse bath to soften and provide antistatic benefits to a 3.5 kg load of fabrics. Preferably, the rinse bath contains from about 20 ppm to about 250 ppm of the fabric softening material. More preferably for United States conditions, the rinse bath contains from about 50 ppm to about 150 ppm of the fabric softening active. More preferably for European conditions, the rinse bath contains from about 250 ppm to about 450 ppm of the fabric softening active. More preferably for Japanese conditions, the rinse bath contains from about 30 ppm to about 80 ppm of the fabric softening active. These concentration levels achieve superior fabric softening and static control.

The invention is exemplified by the following non-limiting examples in which all numerical values are approximations consistent with normal experience.

In the specification and examples herein, all percentages, ratios and parts are by weight unless otherwise specified, and all numerical limits are normal approximations.

EXAMPLES I AND II

| Components | I Wt. % | II Wt. % |
|---|---|---|
| Ester Quat Compound[1] | 87 | 85.5 |
| Ethoxylated Fatty Alcohol[2] | 6 | — |
| Coconut Choline Ester Chloride | — | 8 |
| Perfume | 3.5 | 4 |
| Tartaric Acid | 1 | — |
| Citric Acid | — | 0.25 |
| Minors (Antifoam, etc.) | 1 | 1 |
| Electrolytes | 1.5 | 1.25 |

[1]Di(soft tallowoyloxyethyl) dimethyl ammonium chloride where the tallowyl groups are derived from tallow fatty acids with an IV of about 55, % unsaturation of abuot 53.1, and $C_{18}$ cis/trans isomer ratio of about 8.2 (% cis isomer about 40.0 and % trans isomer about 4.9); the compound contains both diester and monoester at a weight ratio of about 11:1 diester to monoester; 86% solids in ethanol.
[2]$C_{16}$–$C_{18}$ E18 ethoxylated fatty alcohol.

Examples I and II - Process

Molten ester quat compound is mixed, respectively, with molten ethoxylated fatty alcohol or molten coconut choline ester chloride. The other materials are then blended in with mixing. The mixture is cooled and solidified by pouring on a metal plate, and then ground and sieved on an appropriate sieve (e.g., Mesh 22).

EXAMPLES III AND IV

| Components | III Wt. % | IV Wt. % |
|---|---|---|
| Ester Quat Compound[1] | 83.2 | 66.5 |
| Ethoxylated Fatty Alcohol[2] | 10.4 | — |
| Polyglycerol Monostearate[3] | — | 19 |
| Coconut Choline Ester Chloride | — | 9 |
| Perfume | 3.6 | 3 |
| Citric Acid | 0.3 | 0.3 |
| Minors (Antifoam, etc.) | 1 | 1 |
| Electrolytes | 1.5 | 1.2 |

[1]Di(tallowoyloxyethyl) dimethyl ammonium chloride.
[2]$C_{16}$–$C_{18}$ E18 ethoxylated fatty alcohol.
[3]Polyglycerol monostearate having the trade name of Radiasurf ® 7248.

Examples III and IV - Process

The compositions of Examples III and IV are made similarly to those of Examples I and II, except that in Example IV, polyglycerol monostearate is also added.

EXAMPLES V and VI

| Components | V Wt. % | VI Wt. % |
|---|---|---|
| Hydroxyethyl Ester Quat[1] | 85.2 | — |
| Propyl Ester Quat[2] | — | 85.5 |
| Ethoxylated Fatty Alcohol[3] | 9 | — |
| Coconut Choline Ester Chloride | — | 9 |
| Perfume | 3 | 3 |
| Citric Acid | 0.35 | 0.3 |
| Minors (Antifoam, etc.) | 1 | 1 |
| Electrolytes | 1.45 | 1.2 |

[1]Di(tallowoyloxyethyl) (2-hydroxyethyl) methyl ammonium methyl sulfate, 85% active in ethanol.
[2]1,2-Di(hardened tallowoyloxy)-3-trimethylammonium propane chloride.
[3]$C_{16}$–$C_{18}$ E11 ethoxylated fatty alcohol Examples V and VI - Process The compositions of Examples V and VI are made similarly to those of Examples I and II.

What is claimed is:

1. A solid particulate cationic fabric softening composition comprising:

(I) from about 50% to about 95% of biodegradable cationic diester fabric softening compound;

(II) from about 0.001% to about 20% of acid modifier in an amount sufficient to create and maintain a pH of from about 2 to about 5 when the composition is added to water; and (III) from 0% to about 30% of dispersibility modifier.

2. A solid particulate composition according to claim 1 wherein said acid modifier is present at a level of from about 0.1% to about 10% and comprises solid, water-soluble Bronsted acid to provide a pH of from about 2 to about 4.5.

3. A composition according to claim 2 wherein said acid modifier is present at a level of from about 0.2% to about 5% to provide a pH of from about 2 to about 4.

4. A composition according to claim 1 wherein said dispersibility modifier is selected from the group consisting of:

a. single-long-chain $C_{10-C22}$ alkyl, cationic surfactant;

b. nonionic surfactant with at least 8 ethoxy moieties; and c. mixtures thereof.

5. A solid particulate composition according to claim 4 wherein said acid modifier is present at a level of from about 0.1% to about 10% and comprises solid, water-soluble Bronsted acid to provide a pH of from about 2 to about 4.5.

6. A solid particulate composition according to claim 1 comprising:

(I) from about 60% to about 90% of diester quaternary ammonium fabric softening compound;

(II) from about 0.1% to about 10% of acid modifier which comprises solid, water-soluble Bronsted acid to provide a pH of from about 2 to about 4.5; and (III) from about 3% to about 30% of dispersibility modifier selected from the group consisting of:

a. single-long-chain $C_{10-C22}$ alkyl, cationic surfactant;

b. nonionic surfactant with at least 8 ethoxy moieties; and c. mixtures thereof;

wherein the ratio of (I) to (III) is from about 15:1 to about 2:1; and the particle size is from about 50 to about 1,000 microns.

7. A solid particulate composition according to claim 6 comprising:

(I) from about 60% to about 90% of diester quaternary ammonium fabric softening compound having the formula:

$$(R)_{4-m}—N^+—[(CH_2)_n—Y—R^2]_m\ X^-$$

wherein each Y is —O—(O)C—, or —C(O)—O—; m is 2 or 3; n is 1 to 4; each R is a $C_1$–$C_6$ alkyl; each $R^2$ is a $C_{11}$–$C_{21}$ hydrocarbyl or substituted hydrocarbyl substituent; and $X^-$ is any softener-compatible anion;

(II) from about 0.2% to about 5% of said acid modifier to provide a pH of from about 2 to about 4; and (III) from about 5% to about 20% of dispersibility modifier selected from the group consisting of:

a. single-long-chain $C_{10}$–$C_{22}$ alkyl, cationic surfactant;

b. nonionic surfactant with at least 8 ethoxy moieties; and c. mixtures thereof.

8. A solid composition according to claim 7 wherein m is 2, and each R is a $C_1$–$C_2$ alkyl group.

9. A solid particulate composition according to claim 8 wherein (III) is a single-long-chain $C_{10-C22}$ alkyl cationic surfactant at an effective level to facilitate dispersion of from about 5 to about 15% of the composition.

10. A solid particulate composition according to claim 8 wherein (III) is a nonionic surfactant at an effective level to facilitate dispersion of from about 5 to about 20% of the composition.

11. A solid particulate composition according to claim 10 wherein (III) is $C_{10-14}$ alcohol poly(10–18)ethoxylate.

12. A solid particulate composition according to claim 8 wherein said acid modifier is selected from the group consisting of: boric acid; sodium bisulfate; potassium bisulfate; sodium phosphate monobasic; potassium phosphate monobasic; citric acid; gluconic acid; glutamic acid; tartaric acid; fumaric acid; maleic acid; malic acid; tannic acid; glycolic acid; chloroacetic acid; phenoxyacetic acid; 1,2,3,4-butane tetracarboxylic acid; benzene sulfonic acid; ortho-toluene sulfonic acid; para-toluene sulfonic acid; phenol sulfonic acid; naphthalene sulfonic acid; benzene phosphonic acid; oxalic acid; 1,2,4,5-pyromellitic acid; 1,2,4-trimellitic acid; adipic acid; benzoic acid; phenylacetic acid; salicylic acid; succinic acid; and mixtures thereof.

13. A solid particulate composition according to claim 12 wherein said acid modifier is selected from the group consisting of: citric acid, gluconic acid, tartaric acid, malic acid, 1,2,3,4-butane tetracarboxylic acid, and mixtures thereof.

14. A solid particulate composition according to claim 6 which additionally comprises an effective amount, up to 10%, of a soil release polymer which provides improved stability to a liquid composition prepared by adding said particulate composition to water.

15. A solid particulate composition according to claim 6 prepared by using a molten premix consisting essentially of: (I) diester quaternary ammonium compound; (II) acidic pH modifier; optionally, (III) dispersibility modifier, and (IV) premix fluidizer selected from the group consisting of:

a. linear fatty monoesters;

b. short chain $C_1$–$C_3$ alcohols;

c. di-substituted imidazoline ester softening compounds;

d. imidazoline or imidazoline alcohols;

e. single-long-chain $C_{10}$–$C_{22}$ alkyl cationic surfactant;

f. di-long-chain $C_{10}$–$C_{22}$ amines and di-long-chain $C_{10}$–$C_{22}$ ester amines, mono-long-chain $C_{10}$–$C_{22}$ amines and mono-long-chain $C_{10}$–$C_{22}$ ester amines, and/or amine oxides;

g. alkyl or alkenyl succinic anhydrides or acids, long-chain $C_8$–$C_{20}$ fatty alcohols, and fatty acids; and h. mixtures thereof.

16. A solid particulate composition according to claim 15 wherein (IV) is selected from the group consisting of 1, 3, 4, 5, and mixtures thereof.

17. A solid particulate composition according to claim 6 comprising:

(I) from about 60% to about 90% of diester quaternary ammonium fabric softening compound having the formula:

$$R^2COOCH_2C(R^2COO)H—CH_2—^+NR_3\ X^-$$

wherein each R is a $C_1$–$C_4$ alkyl, hydroxy alkyl, benzyl group, or mixtures thereof; each $R^2$ is a $C_{11}$–$C_{22}$ alkyl group; and $X^-$ is any water-soluble anion; and (III) from about 5% to about 20% of dispersibility modifier selected from the group consisting of:

a. single-long-chain $C_{10}$–$C_{22}$ alkyl, cationic surfactant;

b. nonionic surfactant with at least 8 moieties; and c. mixtures thereof;

wherein the ratio of (I) to (III) is from about 15:1 to about 2:1; and the particle size is from about 50 to about 1,000 microns.

18. A solid particulate composition according to claim 17 wherein each R is a methyl group and each $R^2$ is a $C_{16}$–$C_{18}$ alkyl group.

19. A solid particulate composition according to claim 17 wherein (III) is a single-long-chain $C_{10}$–$C_{22}$ alkyl cationic surfactant at an effective level to facilitate dispersion of from about 5 to about 15% of the composition.

20. A solid particulate composition according to claim 17 wherein (III) is a nonionic surfactant at an effective level to facilitate dispersion of from about 5 to about 20% of the composition.

21. A solid particulate composition according to claim 20 wherein (III) is $C_{10}$–$C_{14}$ alcohol with poly(10–18)ethoxylate.

22. A solid particulate composition according to claim 17 wherein said acid modifier is selected from the group consisting of: boric acid; sodium bisulfate; potassium bisulfate; sodium phosphate monobasic; potassium phosphate monobasic; citric acid; gluconic acid; glutamic acid; tartaric acid; fumaric acid; maleic acid; malic acid; tannic acid; glycolic acid; chloroacetic acid; phenoxyacetic acid; 1,2,3,4-butane tetracarboxylic acid; benzene sulfonic acid; ortho-toluene sulfonic acid; para-toluene sulfonic acid; phenol sulfonic acid; naphthalene sulfonic acid; benzene phosphonic acid; oxalic acid; 1,2,4,5-pyromellitic acid; 1,2,4-trimellitic acid; adipic acid; benzoic acid; phenylacetic acid; salicylic acid; succinic acid; and mixtures thereof.

23. A solid particulate composition according to claim 22 wherein said acid modifier is selected from the group consisting of: citric acid, gluconic acid, tartaric acid, malic acid, 1,2,3,4-butane tetracarboxylic acid, and mixtures thereof.

24. A solid particulate composition according to claim 1 comprising:

(I) from about 60% to about 90% of diester quaternary ammonium fabric softening compound having the formula:

$$(R)_{4-m}—N^+—[(CH_2)_n—Y—R^2]_m\ X^-$$

wherein each Y is —O—(O)C—, or —C(O)—O—; m is 2 or 3; n is 1 to 4; each R is a $C_1$–$C_6$ alkyl, hydroxyalkyl group, benzyl group, or mixtures thereof, each $R^2$ is a $C_{11}$–$C_{21}$ hydrocarbyl or substituted hydrocarbyl substituent; and $X^-$ is any softener-compatible union;

(II) from about 0.2% to about 5% of said acid modifier to provide a pH of from about 2 to about 4; and (III) from about 5% to about 20% of dispersibility modifier selected from the group consisting of:

a. single-long-chain $C_{10}$–$C_{22}$ alkyl, cationic surfactant;

b. nonionic surfactant with at least 8 ethoxy moieties; and c. mixtures thereof.

25. A solid composition according to claim 24 wherein m is 2, and one R is a $C_1$–$C_6$ hydroxyalkyl group and one R is a $C_1$–$C_6$ alkyl group.

26. A solid particulate composition according to claim 25 wherein (III) is a single-long-chain $C_{10}$–$C_{22}$ alkyl cationic surfactant at an effective level to facilitate dispersion of from about 5 to about 15% of the composition.

27. A solid particulate composition according to claim 7 wherein (III) is a nonionic surfactant at an effective level to facilitate dispersion of from about 5 to about 20% of the composition.

28. A solid particulate composition according to claim 25 wherein said acid modifier is selected from the group consisting of: boric acid; sodium bisulfate; potassium bisulfate; sodium phosphate monobasic; potassium phosphate monobasic; citric acid; gluconic acid; glutamic acid; tartaric acid; fumaric acid; maleic acid; malic acid; tannic acid; glycolic acid; chloroacetic acid; phenoxyacetic acid; 1,2,3,4-butane tetracarboxylic acid; benzene sulfonic acid; ortho-toluene sulfonic acid; para-toluene sulfonic acid; phenol sulfonic acid; naphthalene sulfonic acid; benzene phosphonic acid; oxalic acid; 1,2,4,5-pyromellitic acid; 1,2,4-trimellitic acid; adipic acid; benzoic acid; phenylacetic acid; salicylic acid; succinic acid; and mixtures thereof.

29. A solid particulate composition according to claim 28 wherein said acid modifier is selected from the group consisting of: citric acid, gluconic acid, tartaric acid, malic acid, 1,2,3,4-butane tetracarboxylic acid, and mixtures thereof.

30. A solid particulate composition according to claim 1 suitable for making liquid compositions at a level of from about 5% to about 50% of diester quaternary ammonium compound wherein said solid particulate composition additionally contains at least one ingredient selected from the group consisting of: from about 0.05% to about 5% inorganic electrolyte, from about 0.3% to about 3% of soil release polymer, an effective amount of perfume, dye, antifoam, flow aid, or mixtures thereof, to improve the stability of said concentrated liquid compositions.

31. A cationic fabric softening composition according to claim 1 additionally comprising an effective amount, up to about 10%, of a soil release polymer of the formula:

$$X—(OCH_2CH_2)_n(O—C(O)—R^1—C(O)—OR^2)_u(O—C(O)—R^1—C(O)—O)(CH_2CH_2O—)_n—X$$

wherein: each X is $C_1$–$C_4$ alkyl or acyl groups, or hydrogen; each n is 6 to 113; u is essentially less than about 10; Each $R^1$ is essentially phenylene, arylene, alkarylene, alkylene, alkenylene moieties, or mixtures thereof, each $R^2$ is essentially ethylene or substituted ethylene, 1,2-propylene moieties, or mixtures thereof, wherein said polymer provides improved stability to those liquid compositions made by adding water to said particulate compositions.

32. A cationic fabric softening composition according to claim 31 wherein: each X is methyl; each n is about 40; u is about 4; each $R^1$ is essentially 1,4-phenylene moieties; and each $R^2$ is essentially ethylene, 1,2-propylene moieties, or mixtures thereof.

* * * * *